US006299292B1

(12) United States Patent
Edwards

(10) Patent No.: US 6,299,292 B1
(45) Date of Patent: Oct. 9, 2001

(54) DRIVER CIRCUIT WITH LOW SIDE DATA FOR MATRIX INKJET PRINTHEAD, AND METHOD THEREFOR

(75) Inventor: Mark Joseph Edwards, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/371,458

(22) Filed: Aug. 10, 1999

(51) Int. Cl.[7] ..... B41J 2/05
(52) U.S. Cl. ..... 347/57; 347/58
(58) Field of Search ..... 347/13, 42, 57, 347/58, 59, 145, 180, 181, 182

(56) References Cited

U.S. PATENT DOCUMENTS

| | | | | |
|---|---|---|---|---|
| 4,567,570 | | 1/1986 | Peer . | |
| 4,719,477 | | 1/1988 | Hess . | |
| 4,947,192 | | 8/1990 | Hawkins et al. . | |
| 5,045,870 | | 9/1991 | Lamey et al. . | |
| 5,051,755 | | 9/1991 | Takahashi et al. . | |
| 5,081,474 | | 1/1992 | Shibata et al. . | |
| 5,122,812 | | 6/1992 | Hess et al. . | |
| 5,159,353 | | 10/1992 | Fasen et al. . | |
| 5,187,500 | * | 2/1993 | Bohorquez et al. | 347/59 |
| 5,363,134 | | 11/1994 | Barbehenn et al. . | |
| 5,442,381 | * | 8/1995 | Fukubeppu et al. | 347/180 |
| 5,638,101 | | 6/1997 | Keefe et al. . | |
| 5,644,342 | | 7/1997 | Argyres . | |
| 5,736,997 | | 4/1998 | Bolash et al. . | |

* cited by examiner

*Primary Examiner*—John Barlow
*Assistant Examiner*—Juanita Stephens
(74) *Attorney, Agent, or Firm*—Needle & Rosenberg, P.C.

(57) ABSTRACT

A driver circuit for an matrix type inkjet printhead having a plurality of first heater resistors arranged in a matrix comprising a plurality of groups of heater resistors. The driver circuit comprises a plurality of first switches and a plurality of second switches. Each of the plurality of first switches is coupled to a heater resistor in each of the plurality of groups and is responsive to one of a plurality of first control signals to supply a current to the associated heater resistor. Each of the plurality of second switches is associated with one of the plurality of first switches, and comprises an input, an output and a gate. The input of each of the plurality of second switches is coupled to one of the plurality of first control signals, and the output of each of the plurality of second switches is coupled to the plurality of first switches for one of the plurality of groups of heater resistors. Each of the plurality of second switches is responsive to one of a plurality of second control signals coupled to the gate thereof to transfer one of the plurality of first control signals coupled to its input to an associated one of the plurality of first switches from its output, thereby driving one of the plurality of heater resistors in a group.

14 Claims, 3 Drawing Sheets

DRIVER CIRCUIT WITH LOW SIDE DATA FOR MATRIX INKJET PRINTHEAD, AND METHOD THEREFOR

BACKGROUND OF THE INVENTION

1. Field of the Invention

This invention relates generally to inkjet printers, and more particularly to driver circuitry for matrix inkjet printheads.

2. Related Art

Inkjet printheads for printers are generally classified in two categories: (1) passive and (2) active or "matrix" printheads. Passive printheads comprise a plurality of heater resistors all connected in common to a power supply. The heater resistors are turned on by independent "low" side transistor switches. By contrast, active or matrix type printheads comprise a row and column matrix, where "high" side transistors are provided to couple data to the columns, and a "low" side transistor is provided for each and every heater resistor.

An example of conventional driver circuitry for a matrix type printhead is shown in FIG. 1. In this example, the printhead is a 13×16 heater resistor printhead. The plurality of heater resistors are driven in "columns" or groups 20, each comprising 13 heater resistors on the printhead 30. There are 16 groups in this example. The column driver circuit portion 10 comprises a plurality of high side transistors 12 that provide data to the groups 20 of heater resistors R in response to column data signals P1–P16. That is, data signal P1 is assigned to the first group, data signal P2 is assigned to the second group, etc. Heater resistors R in each group 20 are addressed by an associated low side field effect transistor (FET) 22 through another gating FET 24 in response to address signals A1–A13. That is, address signal A1 is coupled to a first row of heater resistors across all of the groups 20, the address signal A2 is coupled to a second row of heater resistors across all of the groups 20, etc. In operation, the printhead 30 is driven by stepping in time through the 13 different rows of heater resistors R and changing the column data signals for each time slice.

The architecture shown in FIG. 1 requires high side transistors for each group 20. These high side transistors require a low Vcesat that cannot vary substantially from a nominal value and furthermore must carry 400 mA. As a result, the column driver circuit portion 10 is relatively expensive. The address driver circuit portion, on the other hand, comprises FETs that are relatively simple (small and low current), inexpensive, and easily integrated on the printhead 30.

It would be beneficial to provide the equivalent column driver signals in a manner similar to that provided by the address or "low" side driver circuit. Preferably, it would be desirable to eliminate the column drivers altogether to reduce driver circuitry costs.

SUMMARY OF THE INVENTION

Briefly, the present invention is directed to a driver circuit for an inkjet printhead having a plurality of heater resistors arranged in a matrix comprising a plurality of groups of heater resistors. The driver circuit comprises a plurality of first switches and a plurality of second switches. Each of the plurality of first switches is coupled to a heater resistor in each of the plurality of groups and is responsive to one of a plurality of first control signals to supply a current to the associated heater resistor. Each of the plurality of second switches is associated with one of the plurality of first switches, and comprises an input, an output and a gate. The input of each of the plurality of second switches is coupled to one of the plurality of first control signals, and the output of each of the plurality of second switches is coupled to the plurality of first switches for one of the plurality of groups of heater resistors. Each of the plurality of second switches is responsive to one of a plurality of second control signals coupled to the gate thereof to transfer one of the plurality of first control signals coupled to its input to an associated one of the plurality of first switches from its output, thereby driving one of the plurality of heater resistors in a group.

The above and other objects and advantages of the present invention will become more readily apparent when reference is made to the following description, taken in conjunction with the accompanying drawings.

DETAILED DESCRIPTION OF THE DRAWINGS

Figure 1:
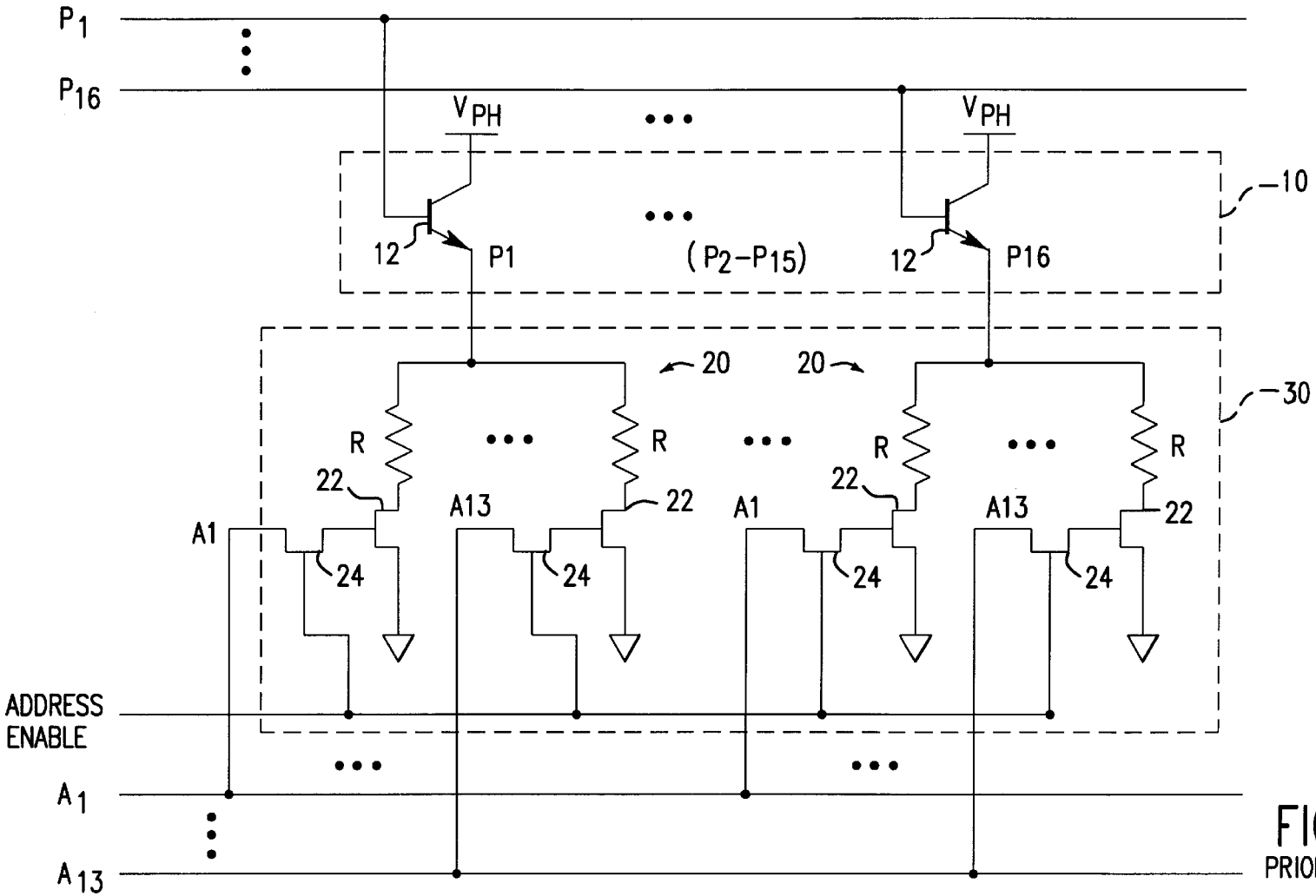
FIG. 1 PRIOR ART
FIG. 1 is a schematic diagram of a prior art driver circuitry architecture.
Figure 2:
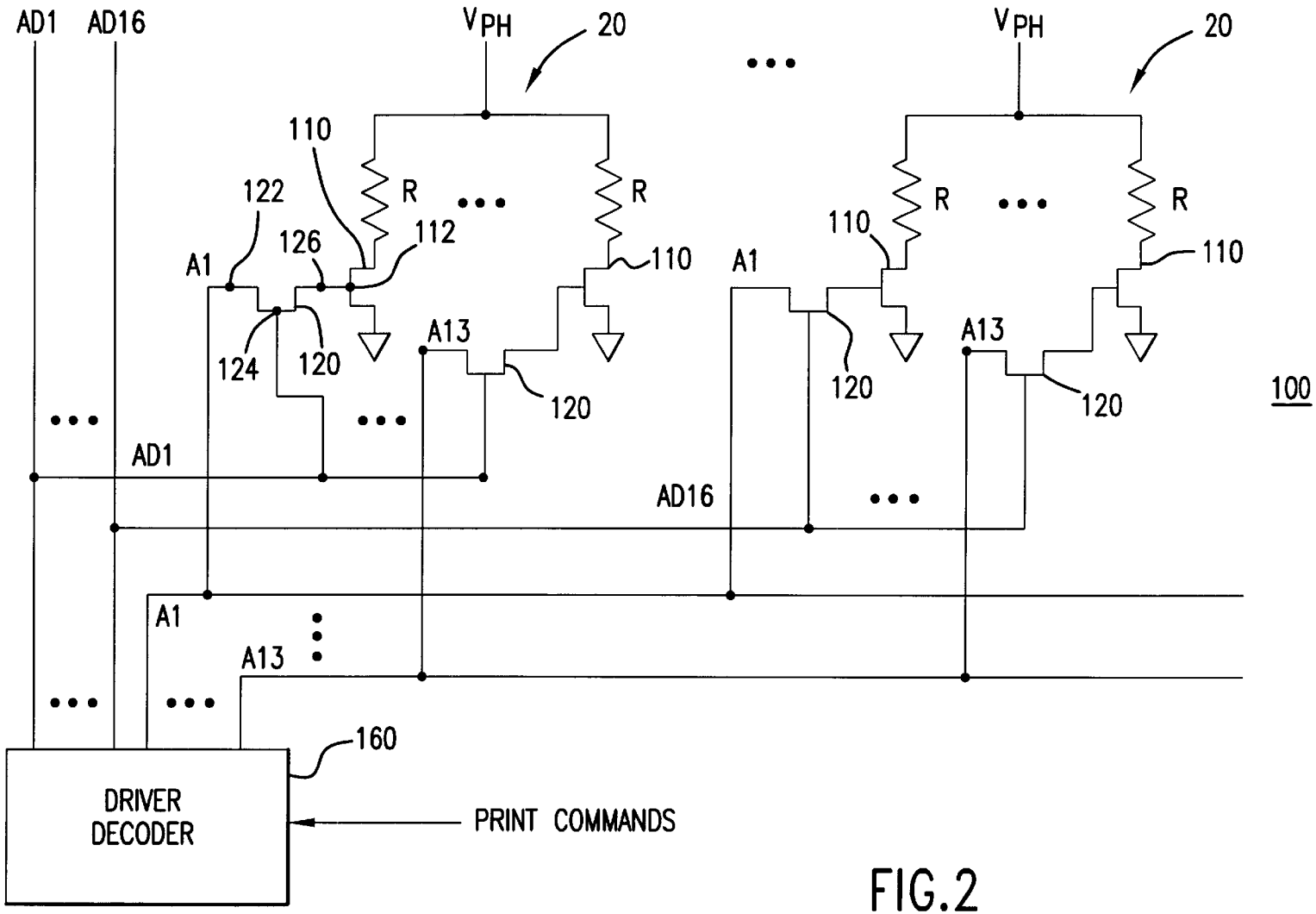
FIG. 2 is a schematic diagram of a driver circuitry architecture according to one embodiment of the present invention.

Referring first to FIG. 2, the driver circuit according to the present invention is shown at reference numeral 100. The driver circuit 100 comprises circuitry to drive a matrix of heater resistors R of an inkjet printhead. The matrix shown is 13×16, as an example. Within the matrix, the heater resistors R are arranged in groups 20, similar to that shown in FIG. 1. The driver circuit 100 comprises a plurality of first switches 110 each connected in series between one terminal of a heater resistor R and ground. A voltage supply $V_{PH}$ is connected to the other terminal of each heater resistor R. Each switch 110, when closed, provides a current path from the voltage supply $V_{PH}$ through the associated heater resistor R to ground, thereby energizing the associated heater resistor R on the printhead. A plurality of second switches 120 are provided, each associated with and connected to one of the plurality of first switches 110. The plurality of second switches 120 are essentially gates that control when one of the plurality of first switches is enabled.

Each switch 120 has three terminals: an input terminal 122, a gate terminal 124 and an output terminal 126. As will be explained below, if complimentary metal oxide silicon (CMOS) field effect transistors (FETs) for the switches 120 are used, then the input terminal 122 is the source terminal, the gate terminal 124 is the gate terminal and the output terminal 126 is the drain terminal. Similarly, switches 110 are three terminal switches and have a gate terminal 112 that is connected to the output terminal 126 of one of the switches 120.

Two sets of control signals are coupled to the switches 120. The first set of controls signals are address signals A1–AN (where N=13 in the example of FIG. 2) and the second set of control signals are address signals AD1–ADM (where M=16 in the example of FIG. 2). Select ones of the address signals A1–AN (on dedicated address signal lines) are coupled to the input terminal 122 of assigned ones of the switches 120. Specifically, address signal A1 is coupled to the input terminal 122 of a switch 120 associated with a first heater resistor R (via a corresponding switch 110) in each column 20, address signal A2 is coupled to the input terminal 122 of a switch 120 associated with a second heater resistor R (via a corresponding switch 110) in each column 20, etc.

Each of the address signals AD1–ADM is assigned to a different group 20 of the heater resistors such that only when the address signal AD1–ADM is present, will any of the heater resistors R in the corresponding group be activated. In this case, address signals AD1–ADM are group select signals because they select which group 20 can be active. For example, address signal AD1 is coupled to the (gate terminals of) switches 120 for the first group 20 of heater resistors, address signal AD2 is coupled to (the gate terminals of) switches 120 for the second group 20 of heater resistors, address signal AD3 is coupled to the (the gate terminals of) switches 120 for the third group 20 of heater resistors, etc. There is an ADx address signal line coupled to the gate terminal for each switch 120.

The particular type of switch used for switches 110 and 120 may vary. As mentioned above, an attractive choice for low power applications and for a minimal footprint are CMOS FETs.

The driver circuit 100 shown in FIG. 2 operates as follows. A source of the address signals A1–An and AD1–ADn is provided, such as a driver decoder 160. The driver decoder 160 receives print command signals and converts them into a proper sequence of address signals A1–An and AD1–ADn for the printhead. When address signal line A1 is active, it is coupled to the switch 110 only for the particular group 20 whose ADn line is active, thereby turning on the switch 110 and activating the heater resistor associated therewith. The An lines are activated individually one line at a time. The ADn lines are changed during each An time. For example, when A1 is active and AD3 is active, then the resistor in the first row of the third group will be activated.

Several benefits are achieved with the architecture shown in FIG. 2. First, it is not necessary to use the higher power ("high side") type transistor switches that are necessary in the designs of the prior art. Second, all data logic is performed outside of the high current path. As a result, this architecture can be achieved with much smaller and easily integrated CMOS switching transistors on the printhead.

Figure 3:
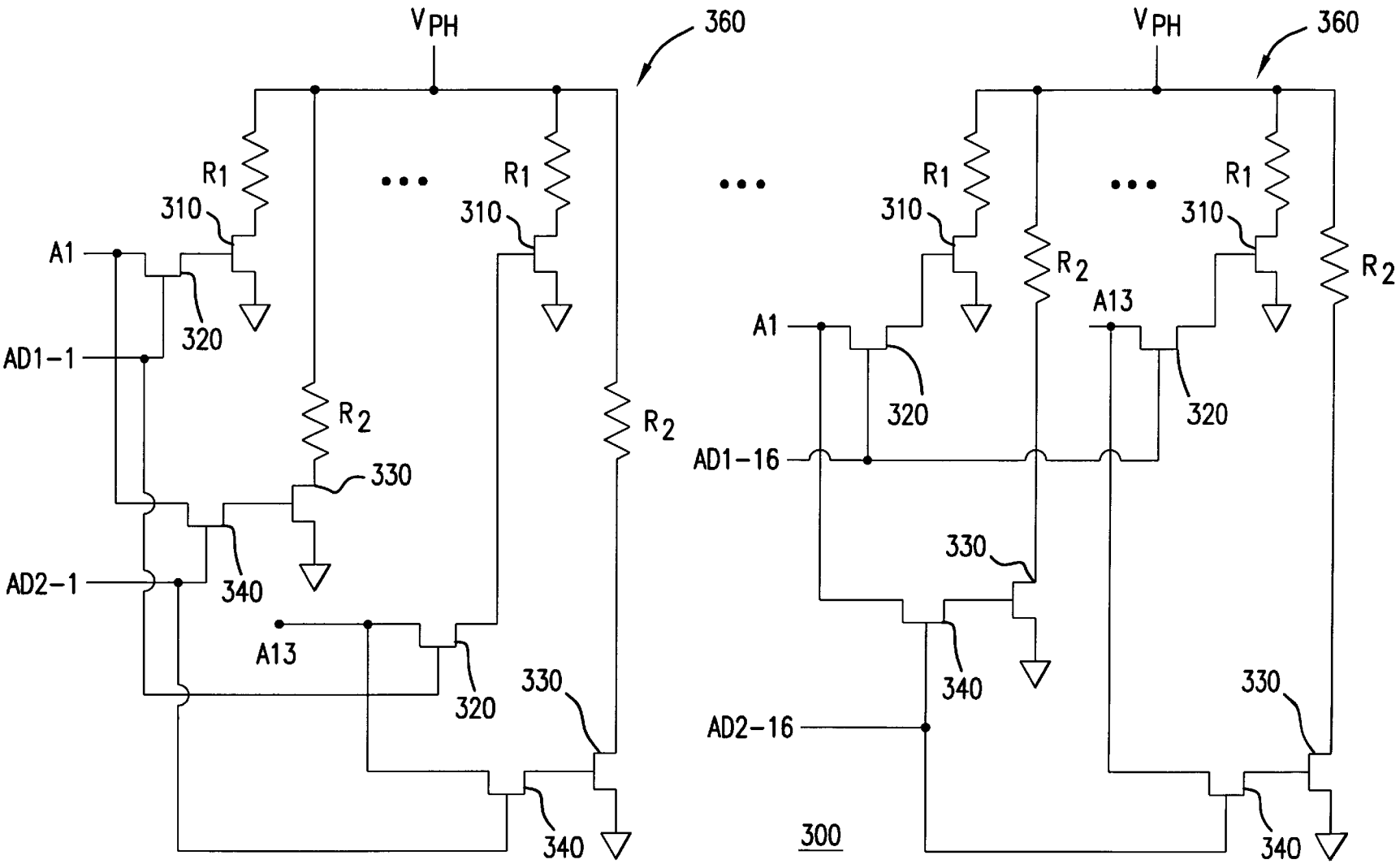
FIG. 3 is a schematic diagram of a driver circuitry architecture according to another embodiment of the present invention.

FIG. 3 illustrates an application of the inventive architecture for a driver circuit 300 used to drive a printhead that contains twice the number of nozzles or heater resistors. For example, the printhead has a second set of heater resistors R2 each in parallel with the first set of heater resistors R1. The heater resistors R2 are, for example, 2 picoliter nozzles whereas the heater resistors R1 are 6 picoliter nozzles. The additional heater resistors R2 make the matrix effectively 26×16. Without the architecture of the present invention, an additional 16 high side driver transistors would be needed to drive the additional heater resistors. However, with the present invention, an additional set of ADx lines is added, such that there are two ADx lines, AD1-x and AD2-x. The address lines AD1-x drive the first set of heater resistors R1 and address lines AD2-x drive the second set of heater resistors R2.

The arrangement of switches in the driver circuit 300 to control the heater resistors R1 and R2 is similar to that of driver circuit 100. Associated with each resistor R1 is one of a plurality of first switches 310. Associated with each of the plurality of first switches 310 is one of a plurality of second switches 320. Similarly, associated with each resistor R2 is one of a plurality of third switches 330. Associated with each of the plurality of third switches 330 is one of a plurality of fourth switches 340. Address signal lines A1–AN drive the heater resistors R1 and R2 by row in each group 360. For example, address signal line A1 drives the heater resistors R1 and R2 in the first row of each group, address signal line A2 drives the heater resistors R1 and R2 in the second row of each group, etc. Address lines AD1-x drive the switches 320 and address lines AD2-x drive the switches 340.

The operation of the driver circuit 300 is as follows. The address lines A1–Ax are activated individually one at a time. The AD1-x and AD2-x address lines are changed during each Ax time. When address line A1 is active, the first row heater of resistors R1 will be activated only in the group 360 whose AD1-x lines are active; the first row of heater resistors R2 will be activated only in the group 360 whose AD2-x lines are active. The AD1-x and AD2-x address lines are typically synchronously made active. As a result, an additional 208 heater resistors are added with relatively simple, low cost and integratable switching logic.

In summary, the driver circuit according to the present invention comprises a plurality of first switches and a plurality of second switches. Each of the plurality of first switches is coupled to a heater resistor in each of the plurality of groups and is responsive to one of a plurality of first control signals to supply a current to the associated heater resistor. Each of the plurality of second switches is associated with one of the plurality of first switches, and comprises an input, an output and a gate. The input of each of the plurality of second switches is coupled to one of the plurality of first control signals, and the output of each of the plurality of second switches is coupled to the plurality of first switches for one of the plurality of groups of heater resistors. Each of the plurality of second switches is responsive to one of a plurality of second control signals coupled to the gate thereof to transfer one of the plurality of first control signals coupled to its input to an associated one of the plurality of first switches from its output, thereby driving one of the plurality of heater resistors in a group. The plurality of second switches operate essentially as a plurality of gates (referred to herein as a plurality of first gates).

To support an even larger matrix of heater resistors, the driver circuit further comprises a plurality of third switches and a plurality of fourth switches, the plurality of third switches being coupled to a plurality of second heater resistors in each of the plurality of groups and being responsive to one of a plurality of first control signals to supply current to the associated one of the plurality of second heater resistors. Each of the plurality of fourth switches comprises an input, an output and a gate, the input of each of the plurality of fourth switches being coupled to an assigned one of the plurality of first control signals, and the output of each of the plurality of fourth switches being coupled to the plurality of third switches for one of the plurality of groups of second heater resistors. Each of the plurality of fourth switches being responsive to one of a plurality of third control signals coupled to the gate therefor to transfer one of the plurality of first control signals coupled to its input to an associated one of the plurality of third switches from its output, thereby driving one of the plurality of second heater resistors in a group.

In addition, the present invention is directed to a method for driving inkjet printhead heater resistors arranged in a matrix comprising a plurality of groups of heater resistors. The method comprises steps of: providing a plurality of switches each coupled to a heater resistor in each of the plurality of groups, each switch being responsive to one of a plurality of control signals to supply a current to an associated heater resistor; and gating the plurality of control signals to the plurality of switches based upon one of a plurality of group select signals associated with each of the plurality of groups.

The above description is intended by way of example only, and is not intended to limit the present invention in any way, except as set forth in the following claims.

What is claimed is:

1. A driver circuit for an inkjet printhead having a plurality of first heater resistors arranged in a matrix comprising a plurality of groups of heater resistors, the driver circuit comprising:

a plurality of first switches, each of which is coupled to a heater resistor in each of the plurality of groups and is responsive to one of a plurality of first control signals to supply a current to the associated heater resistor; and a plurality of second switches associated with each of the plurality of first switches, each of plurality of second switches comprising an input, an output and a gate, the input of each of the plurality of second switches being coupled to one of the plurality of first control signals, and the output of each of the plurality of second switches being coupled to the plurality of first switches for one of the plurality of groups of heater resistors, each of the plurality of second switches being responsive to one of a plurality of second control signals coupled to the gate thereof to transfer one of the plurality of first control signals to an associated one of the plurality of first switches, thereby driving one of the plurality of heater resistors in a group.

2. The driver circuit of claim 1, wherein the plurality of first switches are CMOS field effect transistors each having a source, drain and gate, wherein the source of each of the plurality of first switches is coupled to a first terminal of each of the heater resistors.

3. The driver circuit of claim 2, wherein a heater voltage is coupled to a second terminal of each of the heater resistors.

4. The driver circuit of claim 2, wherein the plurality of second switches are CMOS field effect transistors each having a source, drain and a gate, wherein the source of each of the plurality of second switches is coupled to one of the plurality of first control signals, the drain of each of the plurality of second switches is coupled to the gate of one of the plurality of first switches in a corresponding group, and the gate of the plurality of second switches is coupled to one of the plurality of second control signals.

5. An inkjet printhead comprising the driver circuit of claim 1 integrated therewith.

6. The driver circuit of claim 1, and further comprising a plurality of third switches and a plurality of fourth switches, the plurality of third switches being coupled to a plurality of second heater resistors in each of the plurality of groups and being responsive to one of a plurality of first control signals to supply current to the associated one of the plurality of second heater resistors;

wherein each of the plurality of fourth switches comprises an input, an output and a gate, the input of each of the plurality of fourth switches being coupled to an assigned one of the plurality of first control signals, and the output of each of the plurality of fourth switches being coupled to the plurality of third switches for one of the plurality of groups of second heater resistors, each of the plurality of fourth switches being responsive to one of a plurality of third control signals coupled to the gate therefor to transfer one of the plurality of first control signals coupled to its input to an associated one of the plurality of third switches from its output, thereby driving one of the plurality of second heater resistors in a group.

7. A driver circuit for an inkjet printhead having a plurality of first heater resistors arranged in a matrix comprising a plurality of groups of heater resistors, the driver circuit comprising:

a plurality of first switches, each of which is coupled to a heater resistor in each of the plurality of groups and is responsive to one of a plurality of address signals to supply a current to the associated heater resistor; and a plurality of first gates associated with each of the plurality of first switches, each gate being coupled to the first switches for one of the plurality of groups and being responsive to one of a plurality of first group select signals corresponding to an assigned one of the plurality of groups for coupling the plurality of address signals to the plurality of first switches for a group to thereby energize one of the heater resistors in each of the plurality of groups of the heater resistors.

8. The driver circuit of claim 7, wherein the plurality of first switches are CMOS field effect transistors each having a source, drain and gate, wherein the source of each of the plurality of first switches is coupled to a first terminal of each of the heater resistors.

9. The driver circuit of claim 8, wherein a heater voltage is coupled to a second terminal of each of the heater resistors.

10. The driver circuit of claim 8, wherein the plurality of first gates are CMOS field effect transistors each having a source terminal, a drain terminal and a gate terminal, wherein the source terminal of each of the plurality of first gates is coupled to one of the plurality of first control signals, the drain terminal of each of the plurality of first gates is coupled to the gate of one of the plurality of first switches in a corresponding group, and the gate terminal of the plurality of first gates is coupled to one of the plurality of first group select signals.

11. An inkjet printhead comprising the driver circuit of claim 7 integrated therewith.

12. The driver circuit of claim 7, and further comprising a plurality of second switches, each of which is coupled to one of a plurality of second heater resistors in each of the plurality of groups and is responsive to one of a plurality of address signals to supply a current to the associated second heater resistor; and a plurality of second gates associated with each of the plurality of second switches, each second gate being coupled to one of the plurality of second switches for one of the plurality of groups and being responsive to one of a plurality of second group select signals corresponding to one of the plurality of groups for coupling the plurality of address signals to the plurality of switches for a group to thereby energize one of the second heater resistors in each of the plurality of groups.

13. A method for driving inkjet printhead heater resistors arranged in a matrix comprising a plurality of groups of heater resistors, the method comprising steps of:

providing a plurality of switches each coupled to a heater resistor in each of the plurality of groups, each switch being responsive to one of a plurality of control signals to supply a current to an associated heater resistor; and supplying the plurality of control signals to the plurality of switches based upon one of a plurality of group select signals associated with each of the plurality of groups.

14. The method of claim 13, and further comprising the steps of:

supplying to the plurality of switches the plurality of control signals in a sequence corresponding to row position of heater resistors; and for each control signal, gating the control signal to one or more of the groups of switches.

* * * * *